US008593440B2

(12) United States Patent
Bae et al.

(10) Patent No.: US 8,593,440 B2
(45) Date of Patent: Nov. 26, 2013

(54) LIQUID CRYSTAL DISPLAY

(75) Inventors: Jinsung Bae, Daegu (KR); Woongki Min, Daegu (KR); Byungjin Choi, Gumi-si (KR); Donghak Lee, Gumi-si (KR)

(73) Assignee: LG Display Co., Ltd., Seoul (KR)

( * ) Notice: Subject to any disclaimer, the term of this patent is extended or adjusted under 35 U.S.C. 154(b) by 891 days.

(21) Appl. No.: 12/591,834

(22) Filed: Dec. 2, 2009

(65) Prior Publication Data

US 2010/0321353 A1 Dec. 23, 2010

(30) Foreign Application Priority Data

Jun. 23, 2009 (KR) ..... 10-2009-0056065

(51) Int. Cl.
*G09G 3/36* (2006.01)

(52) U.S. Cl.
USPC ..... 345/205; 345/96; 345/204; 345/92

(58) Field of Classification Search
USPC ..... 345/205
See application file for complete search history.

(56) References Cited

U.S. PATENT DOCUMENTS 6,552,707 B1 * 4/2003 Fujiyoshi ..... 345/98
6,707,441 B1 * 3/2004 Hebiguchi et al. ..... 345/92
6,724,362 B2 * 4/2004 Min ..... 345/100
7,764,262 B2 * 7/2010 Lee ..... 345/99
7,868,861 B2 * 1/2011 Cho et al. ..... 345/87
7,969,397 B2 * 6/2011 Cho et al. ..... 345/87
8,031,153 B2 * 10/2011 Kang et al. ..... 345/96
8,179,351 B2 * 5/2012 Song et al. ..... 345/96
8,279,153 B2 * 10/2012 Song et al. ..... 345/94
2005/0285837 A1 * 12/2005 Akimoto ..... 345/96
2007/0216632 A1 * 9/2007 Lee ..... 345/100
2008/0079678 A1 * 4/2008 Cho et al. ..... 345/88
2008/0170024 A1 * 7/2008 Song et al. ..... 345/96
2008/0170025 A1 * 7/2008 Song et al. ..... 345/96
2008/0291189 A1 * 11/2008 Song et al. ..... 345/209
2009/0167664 A1 * 7/2009 Song et al. ..... 345/94
2009/0174642 A1 * 7/2009 Min et al. ..... 345/92

FOREIGN PATENT DOCUMENTS

CN 101042479 A 9/2007
CN 101226722 A 7/2008

* cited by examiner

*Primary Examiner* — Amare Mengistu
*Assistant Examiner* — Sarvesh J Nadkarni
(74) *Attorney, Agent, or Firm* — McKenna Long & Aldridge, LLP

(57) ABSTRACT

A liquid crystal display is disclosed. The liquid crystal display includes a liquid crystal layer between an upper substrate and a lower substrate, m×n liquid crystal cells arranged in a matrix format according to a crossing structure of m/2 data lines and 2n gate lines, and thin film transistors respectively connected to the m×n liquid crystal cells; a data drive circuit supplying a data voltage to the data lines in response to a polarity control signal; a gate drive circuit sequentially supplying a gate pulse to the gate lines; and a POL logic circuit controlling the polarity control signal so that a phase of the polarity control signal varies every frame period.

4 Claims, 14 Drawing Sheets

FIG. 9

| | R | G | B | R | G | B | R | G |
|---|---|---|---|---|---|---|---|---|
| 1 st frame | + | − | + | − | + | − | + | − |
| | + | − | + | − | + | − | + | − |
| | − | + | − | + | − | + | − | + |
| | − | + | − | + | − | + | − | + |
| 2 nd frame | + | − | + | − | + | − | + | − |
| | − | + | − | + | − | + | − | + |
| | − | + | − | + | − | + | − | + |
| | + | − | + | − | + | − | + | − |
| 3 rd frame | − | + | − | + | − | + | − | + |
| | − | + | − | + | − | + | − | + |
| | + | − | + | − | + | − | + | − |
| | + | − | + | − | + | − | + | − |
| 4 th frame | − | + | − | + | − | + | − | + |
| | + | − | + | − | + | − | + | − |
| | + | − | + | − | + | − | + | − |
| | − | + | − | + | − | + | − | + |

LIQUID CRYSTAL DISPLAY

This application claims the benefit of Korean Patent Application No. 10-2009-0056065 filed on Jun. 23, 2009, the entire contents of which is incorporated herein by reference for all purposes as if fully set forth herein.

BACKGROUND

1. Field of the Invention

Embodiments of the document relate to a liquid crystal display capable of improving the display quality.

2. Discussion of the Related Art

Active matrix type liquid crystal displays display a moving picture using a thin film transistor (TFT) as a switching element. The active matrix type liquid crystal displays have been implemented in televisions as well as display devices in portable devices, such as office equipment and computers, because of the thin profile of an active matrix type liquid crystal displays. Accordingly, cathode ray tubes (CRT) are being rapidly replaced by active matrix type liquid crystal displays.

The liquid crystal display is driven in an inversion manner, in which polarities of neighboring liquid crystal cells are inverted and the polarities of the neighboring liquid crystal cells are inverted every 1 frame period, so as to reduce direct current (DC) offset and to reduce degradation of liquid crystals. If a data voltage with a predetermined polarity is dominantly supplied to the liquid crystal cells for a long time, image sticking may occur. The image sticking generated when the liquid crystal cells are repeatedly charged to the data voltage with the same polarity is called DC image sticking. For example, when the data voltage is supplied to the liquid crystal cells in an interlaced manner, the DC image sticking occurs. In the interlaced manner, the data voltage is supplied to the liquid crystal cells of odd-numbered horizontal lines during odd-numbered frame periods, and the data voltage is supplied to the liquid crystal cells of even-numbered horizontal lines during even-numbered frame periods. As another example of the DC image sticking, if the same image is moved or scrolled at a certain speed, voltages of the same polarity are repeatedly accumulated on the liquid crystal cells depending on a relationship between the size of a scrolled picture and a scrolling speed (moving speed). Hence, the DC image sticking may appear. Examples of polarity control method for reducing the DC image sticking and the flicker are disclosed in detail in Korean Patent Application Nos. 10-2007-035126 (2007 Apr. 10), 10-2007-0004251 (2007 Jan. 15), 10-2007-0004246 (2007 Jan. 15), 10-2007-0008895 (2007 Jan. 29), 10-2007-0037936 (2007 Apr. 18), 10-2007-0047787 (2007 May 16), 10-2007-0053959 (2007 Jun. 1), 10-2007-0052679(2007 May 30), 10-2007-0062238 (2007 Jun. 25), and 10-2006-0064561 (2007 Jun. 28) and U.S. patent application Ser. Nos. 12/003,585 (2007 Dec. 28), 12/003,666 (2007 Dec. 28), and 12/003,746 (2007 Dec. 31) corresponding to the present applicant, and which are hereby incorporated by reference in their entirety.

A panel (hereinafter referred to as a double rate driving (DRD) panel), in which the number of data lines and the number of output channels of a data drive circuit are reduced by connecting adjacent TFTs on the same display line to the same data line, has been developed so as to reduce the circuit cost of the liquid crystal display. According to an experimental result obtained by applying the above-described polarity control method to the liquid crystal display including the DRD panel, 30 Hz-flicker, a flicker in a line direction, a flicker in a column direction, a color distortion in which one of red, green, and blue is remarkably showed, and the like, appeared. Accordingly, technology capable of reducing the DC image sticking, the flicker, the color distortion, etc. has been required even in the liquid crystal display including the DRD panel.

SUMMARY

Embodiments of the document provide a liquid crystal display capable of improving the display quality.

In one aspect, there is a liquid crystal display comprising a liquid crystal display panel including a liquid crystal layer between an upper substrate and a lower substrate of the liquid crystal display panel, m×n liquid crystal cells arranged in a matrix format according to a crossing structure of m/2 data lines and 2n gate lines, and thin film transistors (TFTs) respectively connected to the m×n liquid crystal cells, where m and n are a positive integer, a data drive circuit supplying a data voltage to the data lines in response to a polarity control signal, a gate drive circuit sequentially supplying a gate pulse to the gate lines, and a POL logic circuit controlling the polarity control signal so that a phase of the polarity control signal varies every frame period.

The liquid crystal cells include a first liquid crystal cell positioned on the left side of an odd-numbered data line, a second liquid crystal cell positioned on the right side of the odd-numbered data line, a third liquid crystal cell positioned on the left side of an even-numbered data line, and a fourth liquid crystal cell positioned on the right side of the even-numbered data line.

The TFTs include a first TFT that supplies the data voltage from the odd-numbered data line to a pixel electrode of the first liquid crystal cell in response to a first gate pulse supplied to an odd-numbered gate line, a second TFT that supplies the data voltage from the odd-numbered data line to a pixel electrode of the second liquid crystal cell in response to a second gate pulse supplied to an even-numbered gate line, a third TFT that supplies the data voltage from the even-numbered data line to a pixel electrode of the third liquid crystal cell in response to the second gate pulse, and a fourth TFT that supplies the data voltage from the even-numbered data line to a pixel electrode of the fourth liquid crystal cell in response to the first gate pulse.

The POL logic circuit sequentially outputs first to fourth polarity control signals to generate the polarity control signal.

The POL logic circuit sequentially performs an operation of generating the first polarity control signal during (4i+1)-th frame periods, an operation of generating the second polarity control signal, whose a phase is different from a phase of the first polarity control signal, during (4i+2)-th frame periods, an operation of generating the third polarity control signal, whose a phase is opposite to the phase of the first polarity control signal, during (4i+3)-th frame periods, and an operation of generating the fourth polarity control signal, whose a phase is opposite to the phase of the second polarity control signal, during (4i+4)-th frame periods, where i is a positive integer including zero.

The first polarity control signal has a high logic level of ½ horizontal period, a low logic level of ½ horizontal period, a high logic level of ½ horizontal period, a low logic level of 1 horizontal period, a high logic level of ½ horizontal period, a low logic level of ½ horizontal period, and a high logic level of ½ horizontal period in the order named. The second polarity control signal has a high logic level of ½ horizontal period, a low logic level of 1 horizontal period, a high logic level of ½ horizontal period, a low logic level of ½ horizontal period, a high logic level of 1 horizontal period, and a low logic level of ½ horizontal period in the order named.

BRIEF DESCRIPTION OF THE DRAWINGS

The accompanying drawings, which are included to provide a further understanding of the document and are incorporated in and constitute a part of this specification, illustrate embodiments and together with the description serve to explain the principles. In the drawings:

FIG. 9 illustrates a data polarity of liquid crystal cells charged to a data voltage, whose a polarity is controlled in response to first to fourth polarity control signals, during first to fourth frame periods;

DETAILED DESCRIPTION OF THE EMBODIMENTS

Reference will now be made in detail to embodiments, examples of which are illustrated in the accompanying drawings.

Figure 1:
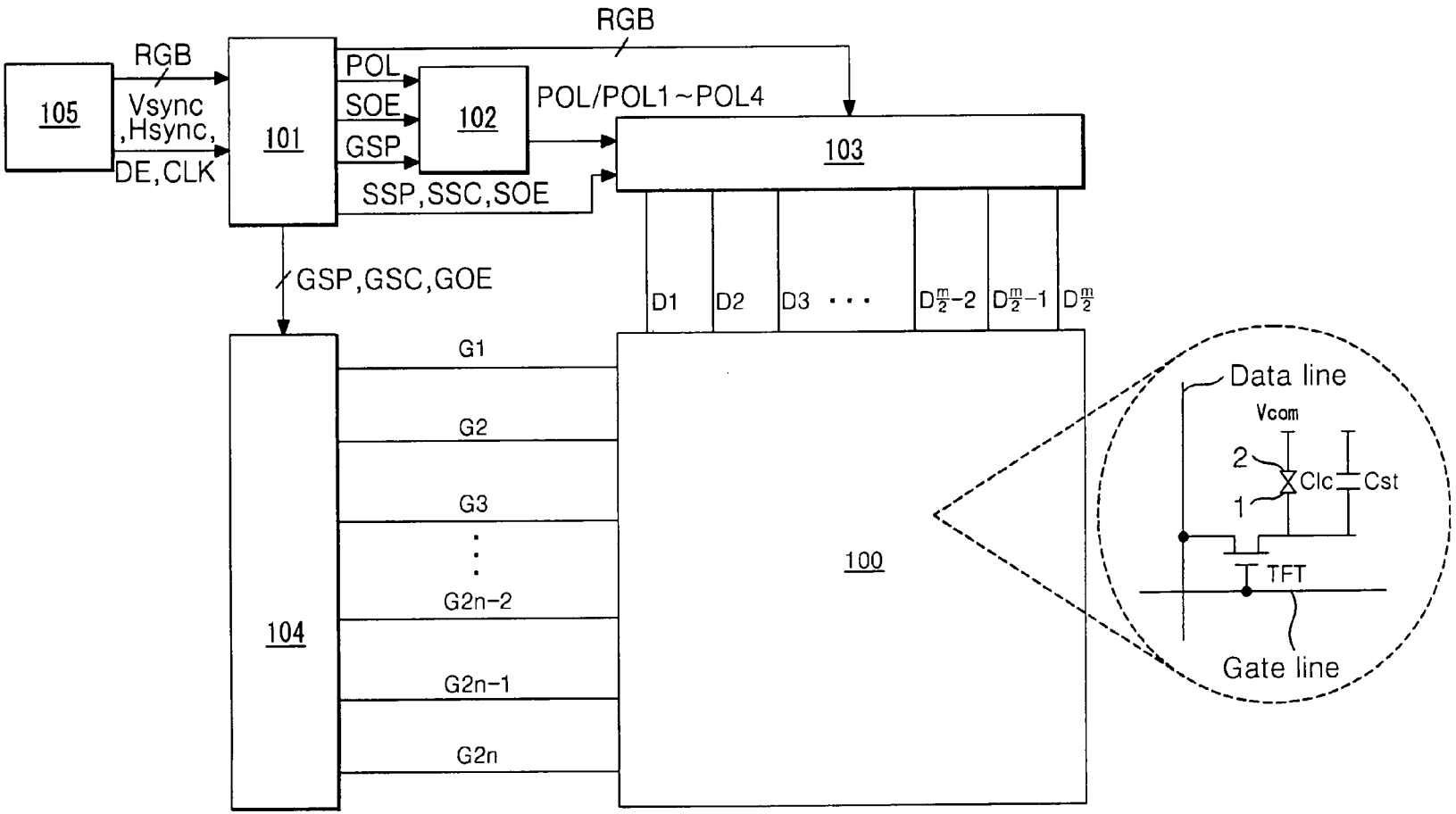
FIG. 1 is a block diagram illustrating a liquid crystal display according to an embodiment.
Figure 2:
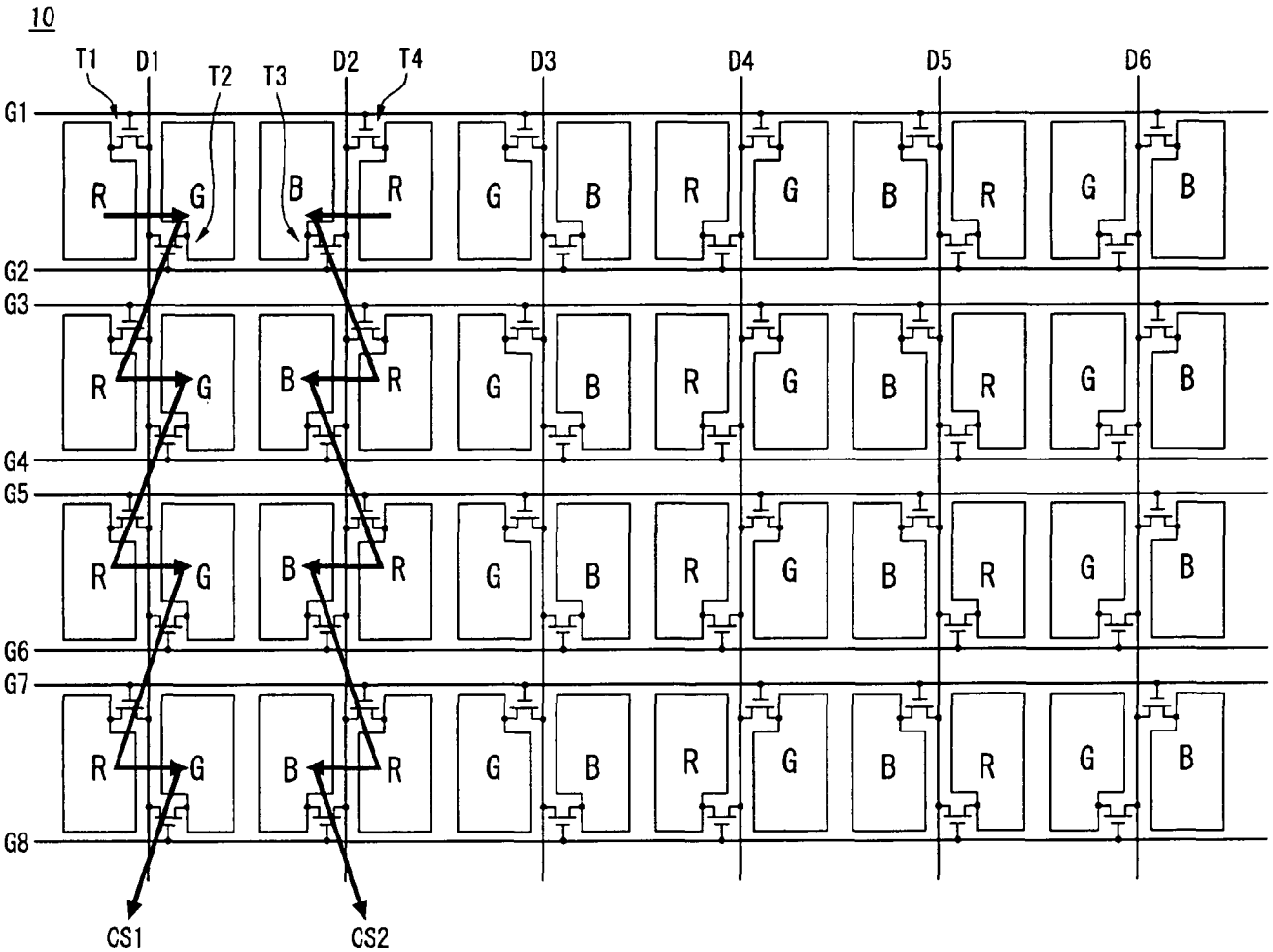
FIG. 2 is an equivalent circuit diagram illustrating in detail a pixel array.

As shown in FIGS. 1 and 2, a liquid crystal display according to an embodiment includes a liquid crystal display panel 100, a timing controller 101, a POL logic circuit 102, a data drive circuit 103, and a gate drive circuit 104.

The liquid crystal display panel 100 includes an upper glass substrate and a lower glass substrate that are positioned opposite each other with a liquid crystal layer interposed between the upper glass substrate and the lower glass substrate. The liquid crystal display panel 100 includes a pixel array 10 displaying video data. The pixel array 10 includes m×n liquid crystal cells Clc arranged in a matrix format according to a crossing structure of m/2 data lines D1 to Dm/2 and 2n gate lines G1 to G2*n* of the liquid crystal display panel 100, where m and n are a positive integer. The m×n liquid crystal cells Clc include m columns (or m vertical display lines), on which the liquid crystal cells Clc are arranged in a direction of the data lines, and n lines (or n horizontal display lines), on which the liquid crystal cells Clc are arranged in a direction of the gate lines. The m×n liquid crystal cells Clc of the pixel array 10 are charged to a data voltage according to an electric field resulting from a difference between the data voltage applied to a pixel electrode 1 through a thin film transistor (TFT) and a common voltage Vcom applied to a common electrode 2 through the TFT and then are hold at the data voltage for a predetermined period of time using a storage capacitor Cst to thereby display an image.

The pixel array 10 includes the m/2 data lines D1 to Dm/2, the 2n gate lines G1 to G2*n*, the m×n pixel electrodes 1, the m×n TFTs respectively connected to the pixel electrodes 1, and the m×n storage capacitors Cst respectively connected to the pixel electrodes 1. The adjacent TFTs on the left and right sides of the same line are connected to the some data line. A connection structure between the TFTs and the data lines is illustrated in FIG. 2. The gate drive circuit 104 connected to the gate lines G1 to G2*n* may be directly formed on a non-display surface of the lower glass substrate of the liquid crystal display panel 100 that is positioned outside the pixel array 10. In this case, the pixel array 10 and the gate drive circuit 104 may be simultaneously formed on the lower glass substrate of the liquid crystal display panel 100 through the same thin film process.

A black matrix, a color filter, and the common electrode 2 are formed on the upper glass substrate of the liquid crystal display panel 100. The common electrode 2 is formed on the upper glass substrate in a vertical electric field driving manner, such as a twisted nematic (TN) mode and a vertical alignment (VA) mode. The common electrode 2 and the pixel electrode 1 are formed on the lower glass substrate in a horizontal electric field driving manner, such as an in-plane switching (IPS) mode and a fringe field switching (FFS) mode.

Polarizing plates are respectively attached to the upper and lower glass substrates of the liquid crystal display panel 100. Alignment layers for setting a pre-tilt angle of liquid crystals are respectively formed on the upper and lower glass substrates.

The liquid crystal display panel 100 applicable to the embodiment may be implemented in any liquid crystal mode as well as the TN, VA, IPS, and FFS modes. The liquid crystal display according to the embodiment may be implemented in any type liquid crystal display including a backlit liquid crystal display, a transflective liquid crystal display, and a reflective liquid crystal display. A backlight unit is necessary in the backlit liquid crystal display and the transflective liquid crystal display. The backlight unit may be implemented as an edge type backlight unit or a direct type backlight unit. In the edge type backlight unit, a plurality of light sources are positioned opposite the side of a light guide plate, and a plurality of optical sheets are positioned between the liquid crystal display panel 100 and the light guide plate. In the direct type backlight unit, a plurality of optical sheets and a diffusion plate are stacked under the liquid crystal display panel 100, and a plurality of light sources are positioned under the diffusion plate. The light source of the backlight unit may use one or at least two of a hot cathode fluorescent lamp (HCFL), a cold cathode fluorescent lamp (CCFL), an external electrode fluorescent lamp (EEFL), and a light emitting diode (LED).

In FIG. 2, the liquid crystal cells Cls and the TFTs positioned on the left side of each of the odd-numbered data lines D1, D3, . . . , Dm/2−1 are respectively called a first liquid crystal cell and a first TFT T1; the liquid crystal cells Cls and the TFTs positioned on the right side of each of the odd-numbered data lines D1, D3, . . . , Dm/2−1 are respectively called a second liquid crystal cell and a second TFT T2; the liquid crystal cells Cls and the TFTs positioned on the left side of each of the even-numbered data lines D2, D4, . . . , Dm/2 are respectively called a third liquid crystal cell and a third TFT T3; and the liquid crystal cells Cls and the TFTs positioned on the right side of each of the even-numbered data lines D2, D4, . . . , Dm/2 are respectively called a fourth liquid crystal cell and a fourth TFT T4.

Each of the first TFTs T1 supplies the data voltage from the odd-numbered data lines D1, D3, . . . , Dm/2−1 to the pixel electrode 1 of each of the first liquid crystal cells in response to a gate pulse (or a scan pulse) from the odd-numbered gate lines G1, G3, . . . , G2*n*−1. For the above operation, in each of the first TFTs T1, a gate electrode is connected to the odd-numbered gate lines G1, G3, . . . , G2*n*−1, a drain electrode is connected to the odd-numbered data lines D1, D3, . . . , Dm/2−1, and a source electrode is connected to the pixel electrode 1 of each first liquid crystal cell. Each of the second TFTs T2 supplies the data voltage from the odd-numbered data lines D1, D3, . . . , Dm/2−1 to the pixel electrode 1 of each of the second liquid crystal cells in response to a gate pulse from the even-numbered gate lines G2, G4, . . . , G2*n*. For the above operation, in each of the second TFTs T2, a gate electrode is connected to the even-numbered gate lines G2, G4, G2*n*, a drain electrode is connected to the odd-numbered data lines D1, D3, . . . , Dm/2−1, and a source electrode is connected to the pixel electrode 1 of each second liquid crystal cell. Each of the third TFTs T3 supplies the data voltage from the even-numbered data lines D2, D4, . . . , Dm/2 to the pixel electrode 1 of each of the third liquid crystal cells in response to a gate pulse from the even-numbered gate lines G2, G4, G2*n*. For the above operation, in each of the third TFTs T3, a gate electrode is connected to the even-numbered gate lines G2, G4, G2*n*, a drain electrode is connected to the even-numbered data lines D2, D4, . . . , Dm/2, and a source electrode is connected to the pixel electrode 1 of each third liquid crystal cell. Each of the fourth TFTs T4 supplies the data voltage from the even-numbered data lines D2, D4, . . . , Dm/2 to the pixel electrode 1 of each of the fourth liquid crystal cells in response to a gate pulse from the odd-numbered gate lines G1, G3, . . . , G2*n*−1. For the above operation, in each of the fourth TFTs T4, a gate electrode is connected to the odd-numbered gate lines G1, G3, . . . , G2*n*−1, a drain electrode is connected to the even-numbered data lines D2, D4, . . . , Dm/2, and a source electrode: is connected to the pixel electrode 1 of each fourth liquid crystal cell.

The data charging order of the liquid crystal cells connected to the odd-numbered data lines D1, D3, . . . , Dm/2−1 and the data charging order of the liquid crystal cells connected to the even-numbered data lines D2, D4, . . . , Dm/2 are reversed depending on a connection relationship between the first to fourth TFTs T1 to T4 and the data lines D1 to Dm/2. In other words, the data charging order (i.e. a charge direction) of the liquid crystal cells connected to the odd-numbered data lines D1, D3, . . . , Dm/2−1 and the data charging order (i.e. a charge direction) of the liquid crystal cells connected to the even-numbered data lines D2, D4, . . . , Dm/2 are symmetrical to each other.

If the data voltage is supplied to the data lines D1 to Dm/2 and the gate pulse synchronized with the data voltage is sequentially supplied to the gate lines G1 to G2*n*, the first liquid crystal cells of (4i+1)-th (where "i" is a positive integer including zero) columns and the second liquid crystal cells of (4i+2)-th columns respectively positioned on the left and right sides of the odd-numbered data lines D1, D3, . . . , Dm/2−1 are sequentially charged to the data voltage in a Z-shaped charging order CS1 as shown in FIG. 2. More specifically, the first liquid crystal cell of the (4i+1)-th column positioned on (i+1)-th line is charged to the data voltage, and then the second liquid crystal cell of the (4i+2)-th column positioned on the right side of the first liquid crystal cell of the (4i+1)-th column on the (i+1)-th line is charged to the data voltage. Subsequently, the first liquid crystal cell of the (4i+1)-th column positioned on (i+2)-th line is charged to the data voltage, and then the second liquid crystal cell of the (4i+2)-th column positioned on the right side of the first liquid crystal cell of the (4i+1)-th column on the (i+2)-th line is charged to the data voltage.

If the data voltage is supplied to the data lines D1 to Dm/2 and the gate pulse synchronized with the data voltage is sequentially supplied to the gate lines G1 to G2*n*, the third liquid crystal cells of (4i+3)-th columns and the fourth liquid crystal cells of (4i+4)-th columns respectively positioned on the left and right sides of the even-numbered data lines D2, D4, . . . , Dm/2 are sequentially charged to the data voltage in an inverse Z-shaped charging order CS2 as shown in FIG. 2. More specifically, the fourth liquid crystal cell of the (4i+4)-th column positioned on (i+1)-th line is charged to the data voltage, and then the third liquid crystal cell of the (4i+3)-th column positioned on the left side of the fourth liquid crystal cell of the (4i+4)-th column on the (i+1)-th line is charged to the data voltage. Subsequently, the fourth liquid crystal cell of the (4i+4)-th column positioned on (i+2)-th line is charged to the data voltage, and then the third liquid crystal cell of the (4i+3)-th column positioned on the left side of the fourth liquid crystal cell of the (4i+4)-th column on the (i+2)-th line is charged to the data voltage.

The timing controller 101 receives timing signals, such as a vertical sync signal Vsync, a horizontal sync signal Hsync, a data enable signal DE, and a dot clock CLK, from a system board 105 through an interface, such as low voltage differential signaling (LVDS) interface and transition minimized differential signaling (TMDS) interface, to generate control signals for controlling operation timing of each of the data drive circuit 103, the gate drive circuit 104, and the POL logic circuit 102. The timing controller 101 transfers in series digital video data RGB to source driver integrated circuits (ICs) of the data drive circuit 103 through mini LVDS interface. The timing controller 11 generates a data timing control signal for controlling the data drive circuit 103 and a gate timing control signal for controlling the gate drive circuit 104 using the timing signals Vsync, Hsync, DE, and CLK. The timing controller 101 may multiply a frequency of each of the data timing control signal and the gate timing control signal based on a frame frequency of (60×j) Hz (where "j" is a positive integer equal to or greater than 2), so that digital video data input at a frame frequency of 60 Hz can be reproduced in the pixel array 10 of the liquid crystal display panel 100 at the frame frequency of (60×j) Hz.

The control signals output from the timing controller 101 include a gate start pulse GSP, a gate shift clock GSC, a gate output enable signal GOE, a source start pulse SSP, a source sampling clock SSC, a source output enable signal SOE, and a reference polarity control signal POL. The gate start pulse GSP indicates a start horizontal line of a scan operation during 1 vertical period in which one screen is displayed. The gate shift clock GSC is a timing control signal that is input to a shift resistor inside the gate drive circuit 104 to sequentially shift the gate start pulse GSP. The gate shift clock GSC has a pulse width corresponding to on-period of the TFT. The gate output enable signal GOE indicates an output of the gate drive circuit 104. The source start pulse SSP indicates a start pixel on 1 horizontal line to which data will be displayed. The source sampling clock SSC indicates a data operation of a latch inside the data drive circuit 103 based on a rising or falling edge. The source output enable signal SOE indicates an output of the data drive circuit 103. The reference polarity control signal POL indicates a polarity of the data voltage that will be supplied to the liquid crystal cells Clc of the liquid crystal display panel 100. A logic level of the reference polarity control signal POL is inverted every "i' horizontal periods. If the timing controller 101 transfers data to the data drive circuit 103 through the mini LVDS interface, the source start pulse SSP and the source sampling clock SSC may be omitted.

The POL logic circuit 102 receives the gate start pulse GSP, the source output enable signal SOE, and the reference polarity control signal POL to sequentially output first to fourth polarity control signals POL1 to POL4. The first to fourth polarity control signals POL1 to POL4 each have a different phase so as to prevent image sticking and flicker. The POL logic circuit 102 may output the same reference polarity control signal POL in each frame.

The data drive circuit 103 latches the digital video data RGB under the control of the timing controller 101. The data drive circuit 103 converts the latched digital video data RGB into analog positive and negative gamma compensation voltages in response to the first to fourth polarity control signals POL1 to POL4 from the POL logic circuit 102 to generate the positive and negative data voltages. The data drive circuit 103 supplies the positive and negative data voltages to the data lines D1 to Dm/2.

The gate drive circuit 104 includes a plurality of gate driver ICs. Each of the gate driver ICs includes a shift resistor, a level shifter for shifting an output signal of the shift resistor to a swing width suitable for a TFT drive of the liquid crystal cells, and an output buffer connected between the level shifter and the gate lines G1 to G2*n*. The gate drive circuit 104 sequentially outputs a gate pulse, having a width of about ½ horizontal period, synchronized with the positive or negative data voltage.

The POL logic circuit 102 may be mounted inside the timing controller 101 or inside the source driver ICS of the data drive circuit 103.

The system board 105 includes a broadcasting signal receiving circuit, an external equipment interface circuit, a graphic processing circuit, a memory, and the like. The system board 105 extracts video data from a broadcasting signal or a video source received from an external equipment and converts the video data into digital video data to supply the digital video data to the timing controller 101. An interlaced broadcasting signal input to the system board 105 exists in only odd-numbered lines during odd-numbered frame periods and exists in only even-numbered lines during even-numbered frame periods. Accordingly, if the system board 105 receives the interlaced broadcasting signal, the system board 105 generates data of even-numbered lines during odd-numbered frame periods and data of odd-numbered lines during even-numbered frame periods using an average value of data or a black data value stored in the memory of the system board 105. The system board 105 supplies the digital video data and the timing signals Vsync, Hsync, DE, and CLK to the timing controller 101 and supplies a power to a module power circuit (not shown). The module power circuit adjusts the voltage received from the system board 105 to generate a voltage required to drive digital circuits of the module power circuit and a driving voltage of the liquid crystal display panel 100.

Figure 3:
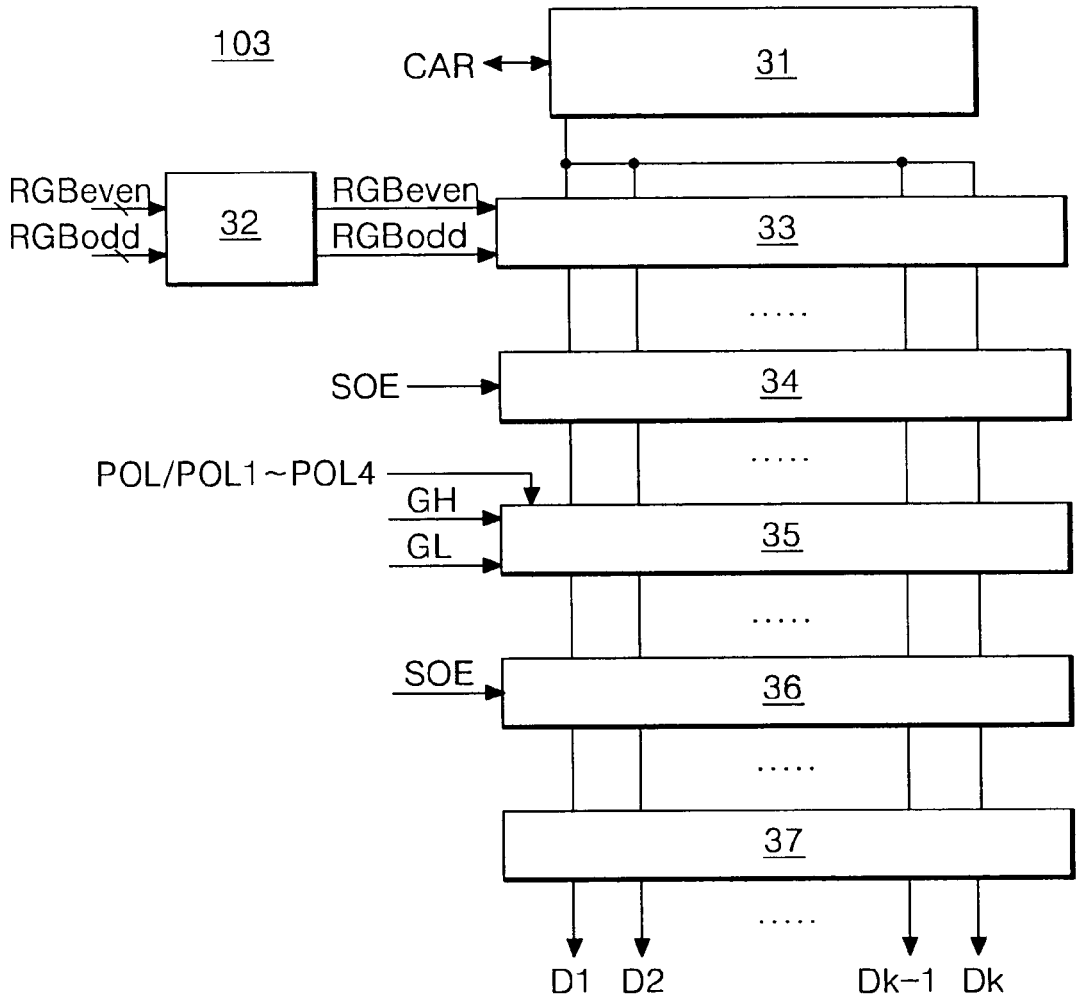
FIGS. 3 and 4 are circuit diagrams illustrating in detail a data drive circuit.
Figure 4:
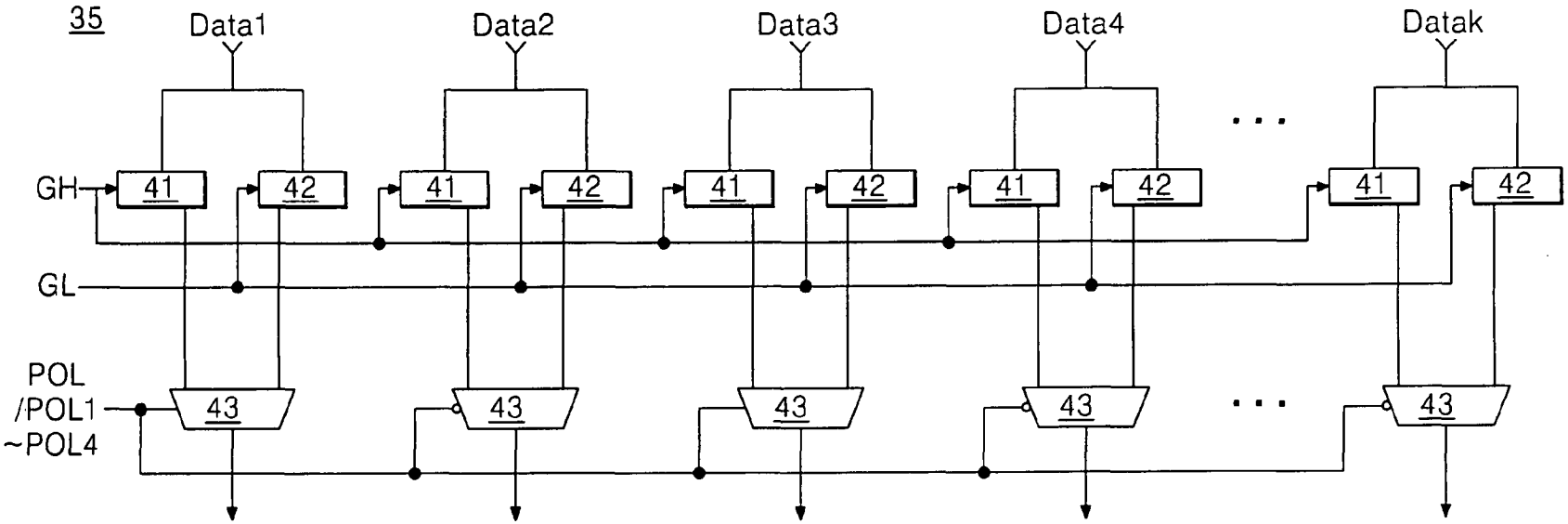

FIGS. 3 and 4 are circuit diagrams illustrating in detail the source driver ICs of the data drive circuit 103.

As shown in FIGS. 3 and 4, each of the source driver ICs supplies the data voltage to k data lines D1 to Dk, where k is a positive integer smaller than m/2. Each of the source driver ICs includes a shift register 31, a data register 32, a first latch 33, a second latch 34, a digital-to-analog converter (DAC) 35, a charge share circuit 36, and an output circuit 37.

The shift register 31 shifts the source sampling clock SSC from the timing controller 101 to generate a sampling clock. Then, the shift register 31 of a source driver IC transfers a carry signal CAR to a shift register 31 of a next source driver IC. The data register 32 temporarily stores odd digital video data RGBodd and even digital video data RGBeven divided by the timing controller 101 and supplies the odd digital video data RGBodd and the even digital video data RGBeven to the first latch 33. The first latch 33 samples and latches the odd digital video data RGBodd and the even digital video data RGBeven in response to the sampling clock sequentially received from the shift register 31. Then, the first latch 33 simultaneously outputs the latched odd and even digital video data RGBodd and RGBeven to the second latch 34. The second latch 34 latches the digital video data received from the first latch 33. Then, the second latch 34 of a source driver IC and the second latches 34 of the other source driver ICs simultaneously output the latched digital video data during a low logic period of the source output enable signal SOE.

The DAC 35, as shown in FIG. 4, includes a P-decoder 41 receiving a positive gamma reference voltage GH, an N-decoder 42 receiving a negative gamma reference voltage GL, and a multiplexer 43 selecting an output of the P-decoder 41 and an output of the N-decoder 42 in response to the polarity control signals POL/POL1 to POL4. The P-decoder 41 decodes the digital video data received from the second latch 34 to output a positive gamma compensation voltage corresponding to a gray level of the decoded digital video data. The N-decoder 42 decodes the digital video data received from the second latch 34 to output a negative gamma compensation voltage corresponding to a gray level of the decoded digital video data. The multiplexer 43 alternately selects the positive gamma compensation voltage and the negative gamma compensation voltage in response to the polarity control signals POL/POL1 to POL4 and outputs the selected positive or negative gamma compensation voltage as the analog positive or negative data voltage. The charge share circuit 36 shorts neighboring data output channels of the data drive circuit during a high logic period of the source output enable signal SOE to output an average value of the neighboring data voltages as a charge share voltage. Otherwise, the charge share circuit 36 supplies the common voltage Vcom to the data output channels during the high logic period of the source output enable signal SOE to reduce a sharp change in each of the positive data voltage and the negative data voltage. The output circuit 37 includes a buffer to reduce a signal attenuation of the positive/negative data voltage supplied to the data lines D1 to Dk, where k is a positive integer smaller than m/2.

Figure 5:
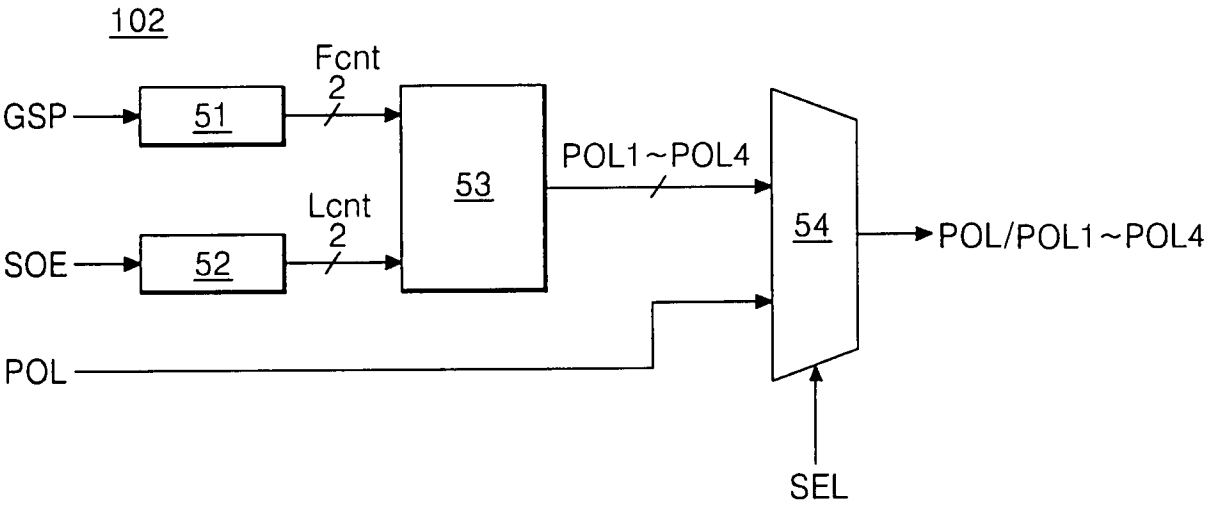
FIGS. 5 and 6 are circuit diagrams illustrating in detail a POL logic circuit.
Figure 6:
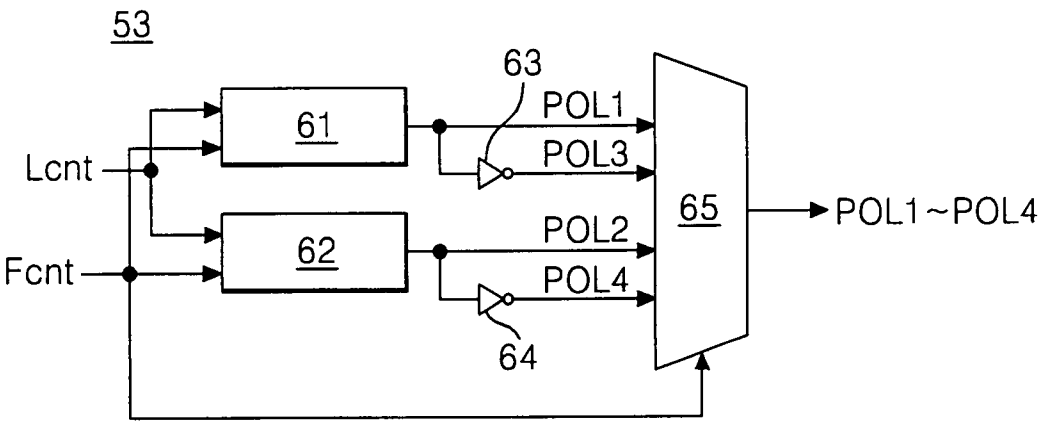
Figure 7:
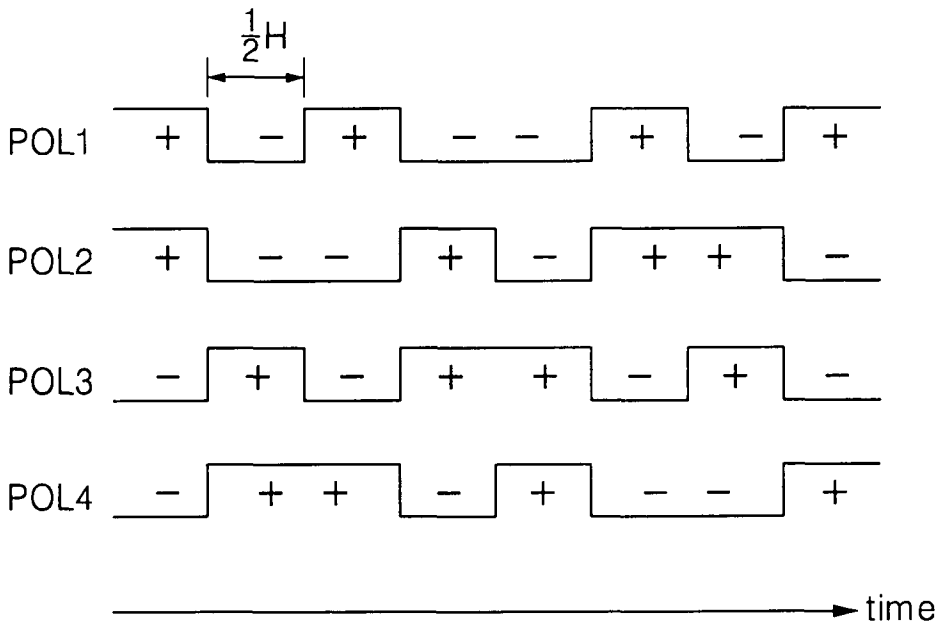
FIG. 7 is a waveform diagram of polarity control signals.

FIGS. 5 and 6 are circuit diagrams illustrating in detail the POL logic circuit 102. FIG. 7 is a waveform diagram of the first to fourth polarity control signals POL1 to POL4 sequentially output from the POL logic circuit 102.

As shown in FIGS. 5 and 6, the POL logic circuit 102 includes a frame counter 51, a line counter 52, a POL generation circuit 53, and a multiplexer 54.

The frame counter 51 counts the gate start pulse GSP, that is once generated during 1 frame period and is generated simultaneously with the start of a frame period, to output a frame count information Fcnt indicating a number of frame periods of an image to be displayed on the liquid crystal display panel 100. The line counter 52 counts clocks of one of the source output enable signal SOE and the gate output enable signal GOE, each of which is generated every about ½ horizontal period, to output a line count information Lcnt indicating a number of horizontal periods to be displayed on the liquid crystal display panel 100. Clocks generated from an internal generator of the timing controller 101 may be used as the timing signals supplied to the frame counter 51 and the line counter 52. However, because the clocks have a high frequency, electromagnetic interference (EMI) may increase between the timing controller 101 and the POL logic circuit 102. On the other hand, because the gate start pulse GSP and the source output enable signal SOE, each of which has a frequency less than the frequency of the clocks and is generated from the internal generator of the timing controller 101 are respectively input to the frame counter 51 and the line counter 52, an increase in the EMI between the timing controller 101 and the POL logic circuit 102 may be reduced.

The POL generation circuit 53 includes a first POL generation circuit 61, a second POL generation circuit 62, first and second inverters 63 and 64, and a multiplexer 65. As shown in FIG. 7, the first POL generation circuit 61 toggles an output signal according to the line count information Lcnt to generate the first polarity control signal POL1 for controlling a polarity of the data voltage to which the liquid crystal cells Clc are charged during a first frame period. The first polarity control signal POL1 has a high logic level (+) of ½ horizontal period ½H, a low logic level (−) of ½ horizontal period ½H, a high logic level (+) of ½ horizontal period ½H, a low logic level (−) of 1 horizontal period 1H, a high logic level (+) of ½ horizontal period ½H, a low logic level (−) of ½ horizontal period ½H, and a high logic level (+) of ½ horizontal period ½H in the order named. The first inverters 63 inverts the first polarity control signal POL1 to generate the third polarity control signal POL3 for controlling a polarity of the data voltage to which the liquid crystal cells Clc are charged during a third frame period. The second POL generation circuit 62 toggles an output signal according to the line count information Lcnt to generate the second polarity control signal POL2 for controlling a polarity of the data voltage to which the liquid crystal cells Clc are charged during a second frame period. The second polarity control signal POL2 has a high logic level (+) of ½ horizontal period ½H, a low logic level (−) of 1 horizontal period 1H, a high logic level (+) of ½ horizontal period ½H, a low logic level (−) of ½ horizontal period ½H, a high logic level (+) of 1 horizontal period 1H, and a low logic level (−) of ½ horizontal period ½H in the order named. The second inverters 64 inverts the second polarity control signal POL2 to generate the fourth polarity control signal POL4 for controlling a polarity of the data voltage to which the liquid crystal cells Clc are charged during a fourth frame period.

The multiplexer 65 sequentially performs an output of the first polarity control signal POL1 during (4i+1)-th frame periods, an output of the second polarity control signal POL2 during (4i+2)-th frame periods, an output of the third polarity control signal POL3 during (4i+3)-th frame periods, and an output of the fourth polarity control signal POL4 during (4i+4)-th frame periods according to the frame count information Fcnt.

A control terminal of the multiplexer 54 may be connected to an option pin of the POL logic circuit 102. A ground level voltage GND or a power source voltage Vcc may be applied to the option pin of the POL logic circuit 102. The multiplexer 54 selects the polarity control signals POL1 to POL4 from the POL generation circuit 53 or the reference polarity control signal POL in response to the voltage of the option pin of the POL logic circuit 102 or a selection control signal SEL (shown in FIG. 5). The option pin of the POL logic circuit 102 is connected to the control terminal of the multiplexer 54, and the ground level voltage GND or the power source voltage Vcc may be selectively applied to the option pin of the POL logic circuit 102. For example, if the ground level voltage GND is applied to the option pin of the POL logic circuit 102, a voltage of low logic level is applied to the control terminal of the multiplexer 54, and thus the multiplexer 54 outputs the reference polarity control signal POL. On the other hand, if the power source voltage Vcc is applied to the option pin of the POL logic circuit 102, a voltage of high logic level is applied to the control terminal of the multiplexer 54. In other words, the selection control signal SEL of high logic level '1' is applied to the control terminal of the multiplexer 54, and thus the POL generation circuit 53 outputs the first to fourth polarity control signals POL1 to POL4. The selection control signal SEL may be automatically generated from the system board 105 or the timing controller 101 in response to a user selection signal input through a user interface or according to a data analysis result. Thus, the multiplexer 54 may operate in response to the user selection signal or according to the data analysis result.

Figure 8:
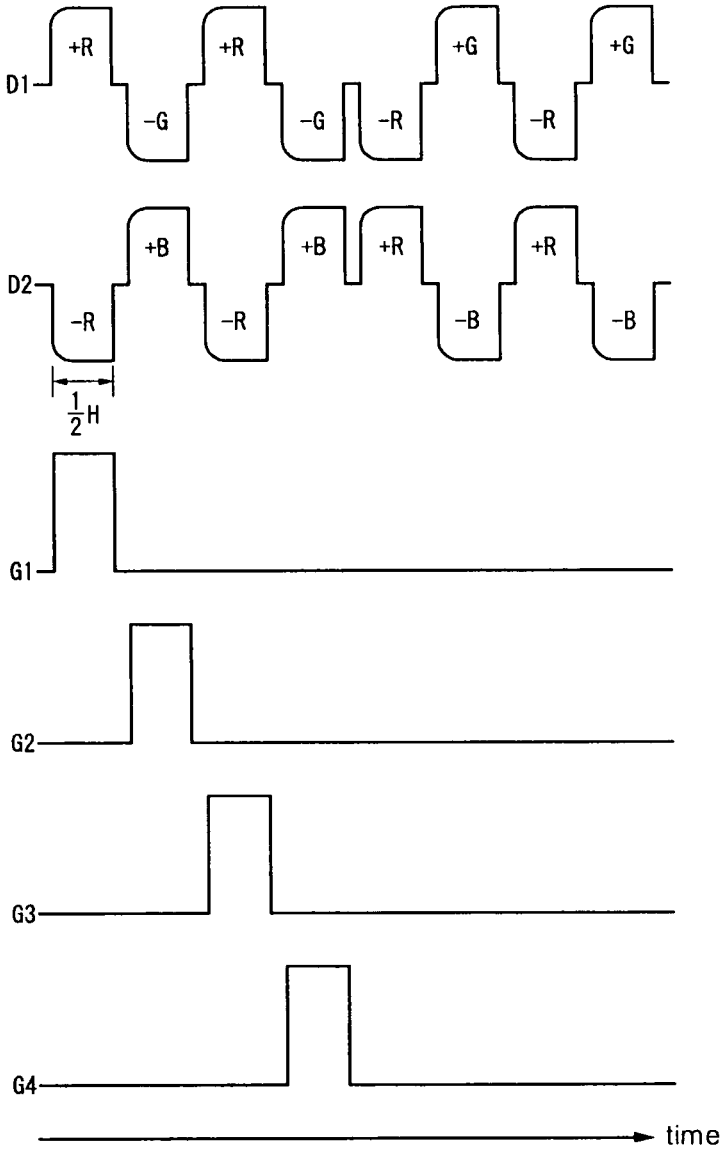
FIG. 8 is a waveform diagram of a data voltage, whose a polarity is controlled in response to a first polarity control signal, and a gate pulse synchronized with the data voltage.

FIG. 8 is a waveform diagram illustrating an example of the data voltage generated in response to the first polarity control signal POL1 during a first frame period.

As shown in FIG. 8, the data drive circuit 103 sequentially supplies the positive data voltage (+R, +G, +B), the negative positive data voltage (−R, −G, −B), the positive data voltage (+R, +G, +B), the negative positive data voltage (−R, −G, −B), the negative positive data voltage (−R, −G, −B), the positive data voltage (+R, +G, +B), the negative positive data voltage (−R, −G, −B), and the positive data voltage (+R, +G, +B) in the order named to the odd-numbered data lines D1, D3, . . . , Dm/2−1 in response to the first polarity control signal POL1. The data drive circuit 103 sequentially supplies the data voltage, whose a polarity is opposite to the polarity of the data voltage supplied to the odd-numbered data lines D1, D3, . . . , Dm/2−1 in response to the first polarity control signal POL1, to the even-numbered data lines D2, D4, . . . , Dm/2. The gate drive circuit 104 sequentially generates the gate pulse of about ½ horizontal period synchronized with the positive/negative data voltage.

Each of the first TFTs T1 supplies the data voltage from the odd-numbered data lines D1, D3, . . . , Dm/2−1 to the pixel electrode 1 of each of the first liquid crystal cells in response to a first gate pulse supplied to the odd-numbered gate lines G1, G3, . . . , G2*n*−1. Each of the second TFTs T2 supplies the data voltage from the odd-numbered data lines D1, D3, . . . , Dm/2-1 to the pixel electrode 1 of each of the second liquid crystal cells in response to a second gate pulse supplied to the even-numbered gate lines G2, G4, G2*n*. Each of the third TFTs T3 supplies the data voltage from the even-numbered data lines D2, D4, . . . , Dm/2 to the pixel electrode 1 of each of the third liquid crystal cells in response to the second gate pulse. Each of the fourth TFTs T4 supplies the data voltage from the even-numbered data lines D2, D4, . . . , Dm/2 to the pixel electrode 1 of each of the fourth liquid crystal cells in response to the first gate pulse.

FIG. 9 illustrates a data polarity of the liquid crystal cells Clc charged to the data voltage, whose a polarity is controlled in response to the first to fourth polarity control signals POL1 to POL4, during first to fourth frame periods. Because the liquid crystal cells Clc are charged to the data voltage whose a polarity is controlled in response to the first to fourth polarity control signals POL1 to POL4, an image in which DC image sticking, flicker, and color distortion scarcely appear, may be displayed.

Figure 10:
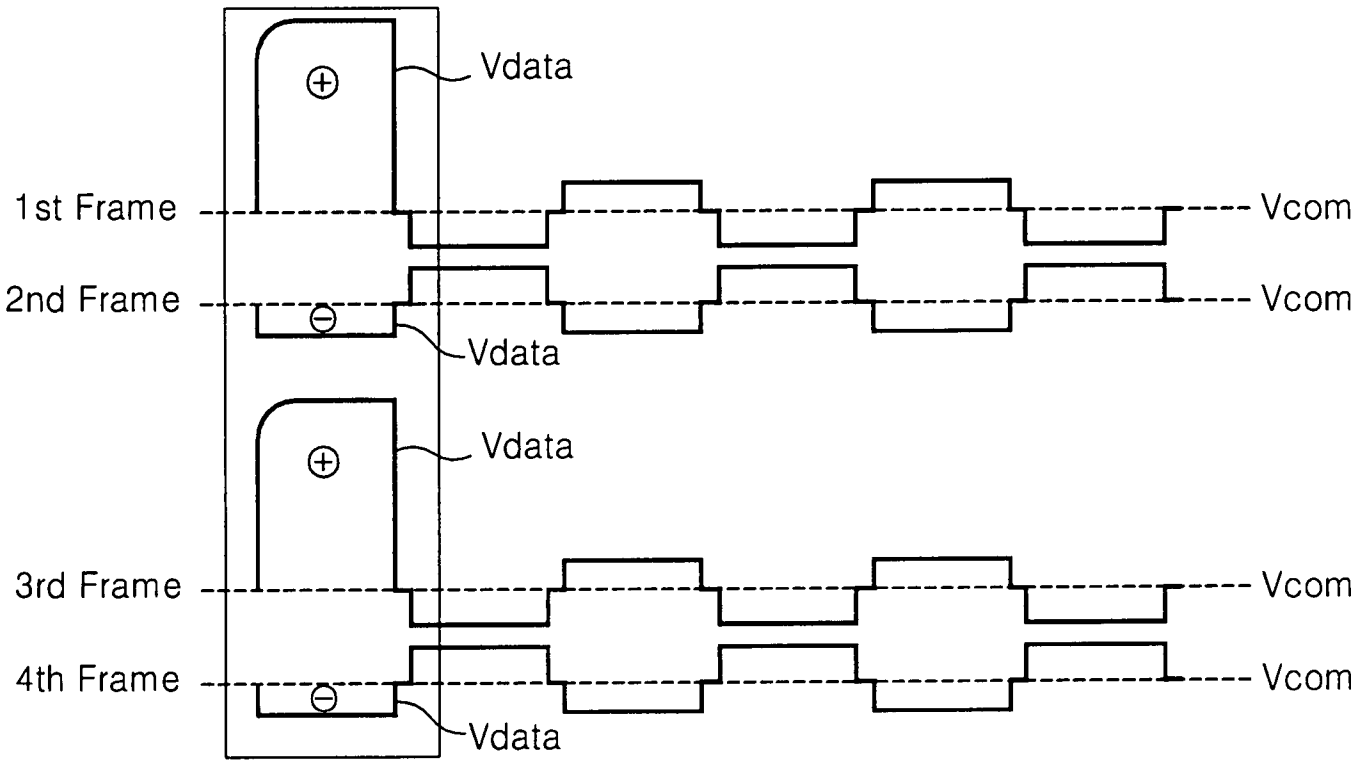
FIG. 10 is a waveform diagram illustrating a generation principle of DC image sticking when interlaced data is input to a liquid crystal display.
Figure 11:
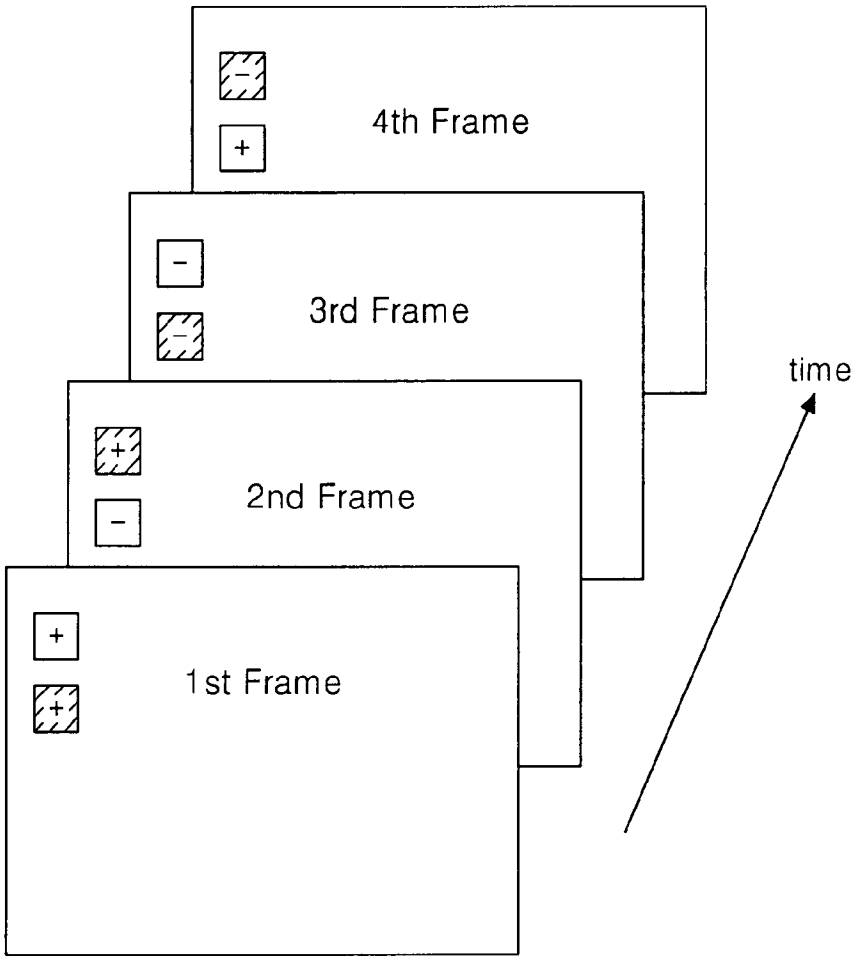
FIG. 11 illustrates changes in a polarity of a data voltage supplied to each of a liquid crystal cell for reducing DC image sticking and a liquid crystal cell adjacent to the liquid crystal cell for reducing a flicker.
Figure 12:
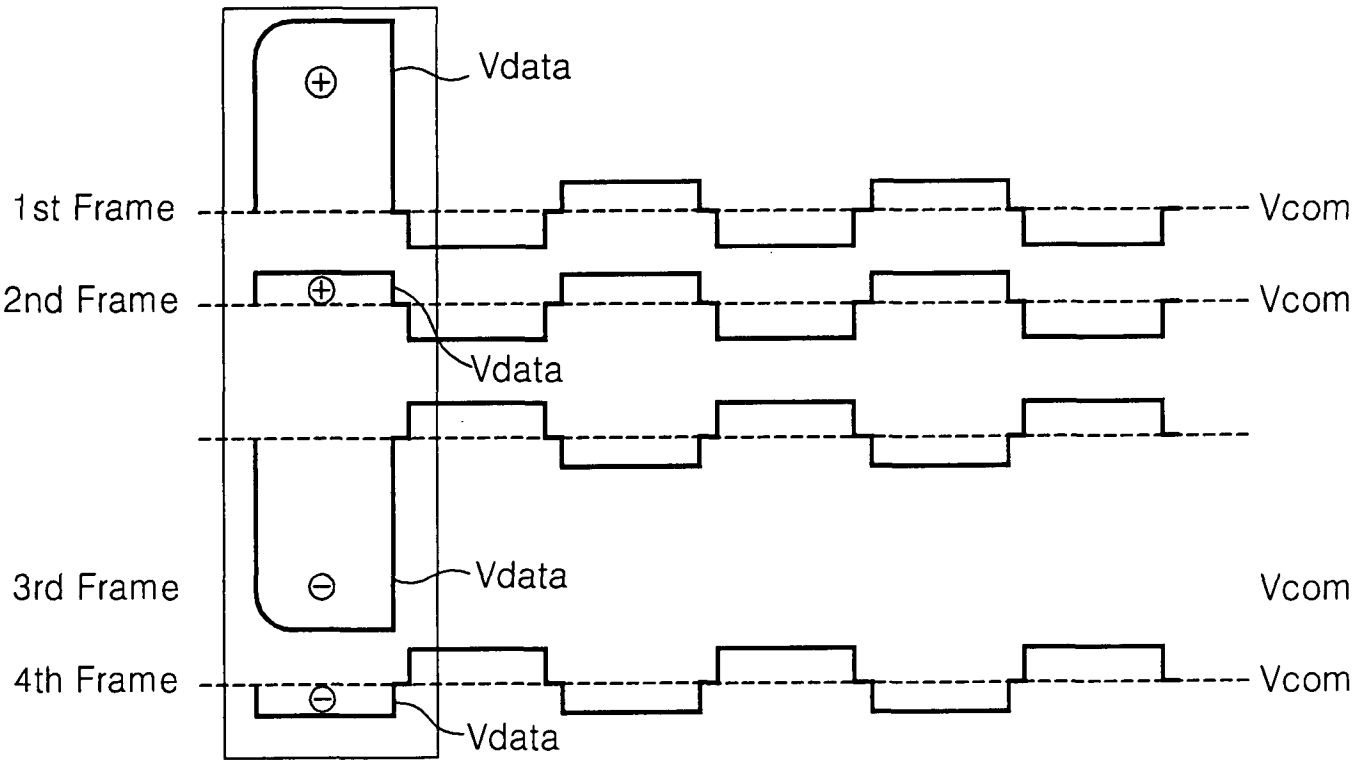
FIG. 12 is a waveform diagram illustrating a principle by which DC image sticking does not appear when interlaced data is input to a liquid crystal display through the liquid crystal cells shown in FIG. 11.

In the embodiment, an effect obtained by reducing interlaced image sticking and the flicker is below described with reference to FIGS. 10 to 12.

It is assumed that interlaced data is displayed on the liquid crystal display panel and a polarity of the data voltage supplied to all of the liquid crystal cells Clc is inverted every 1 frame period in the same manner as a related art manner. In this case, the liquid crystal cells Clc are charged to the positive data voltage during odd-numbered frame periods and are charged to the negative data voltage during even-numbered frame periods. In an interlaced manner, because the liquid crystal cells Clc charge the positive data voltage during the odd-numbered frame periods, a charge amount of the positive data voltage of the liquid crystal cells Clc is much more than a charge amount of the negative data voltage of the liquid crystal cells Clc during 4 frame periods as indicated by the box shown in FIG. 10. Accordingly, when the polarity of the data voltage supplied to all of the liquid crystal cells Clc is inverted every 1 frame period and the interlaced data is input to the liquid crystal display, the DC image sticking and the flicker appear because one of two polarities of the data voltage supplied to all of the liquid crystal cells is more dominantly than the other polarity.

In the embodiment, the DC image sticking, the flicker, and the color distortion can be reduced in a double rate driving (DRD) panel by controlling the polarity of the data voltage using the first to fourth polarity control signals POL1 to POL4 each having a different phase. As shown in FIGS. 7 to 9 and FIGS. 11 and 12, polarity inversion cycles of the data voltages, to which a hatched liquid crystal cell (hereinafter referred to as a first liquid crystal cell) and a liquid crystal cell (hereinafter referred to as a second liquid crystal cell) adjacent to the hatched liquid crystal cell are charged, are different from each other because of the first to fourth polarity control signals POL1 to POL4. For example, as shown in FIG. 11, while a polarity of the data voltage supplied to the first liquid crystal cell is not inverted and remains in the same state during 2 frame periods, a polarity of the data voltage supplied to the second liquid crystal cell is once inverted during the 2 frame periods. Hence, the DC image sticking can be prevented by charging the first liquid crystal cell to the data voltage of the same polarity during the 2 frame periods. Further, because the polarity of the data voltage supplied to the second liquid crystal cell is once inverted during the 2 frame periods, a spatial frequency of the second liquid crystal cell increases. Hence, the flicker can be prevented. The prevention effect of the DC image sticking obtained by the first liquid crystal cell can be seen from FIG. 12. When interlaced data is displayed on the liquid crystal display, the polarity of the data voltage supplied to the first liquid crystal cell is inverted every 2 frame periods. As a result, because there is little difference between a charge amount of the positive data voltage supplied to the first liquid crystal cell and a charge amount of the negative data voltage of the first liquid crystal cell, one of two polarities of the data voltage supplied to the first liquid crystal cell is not dominant than the other polarity. Accordingly, even if the interlaced data is displayed on the liquid crystal display, one of two polarities of the data voltage supplied to the liquid crystal cells is not dominant than the other polarity. Hence, the DC image sticking does not appear.

The DC image sticking can be prevented by the first liquid crystal cell, but the flicker may appear because the data voltages of the same polarity are supplied to the liquid crystal cells every 2 frame periods. Because the second liquid crystal cell is charged to the data voltages of different polarities during two frame periods when the first liquid crystal cell is charged to the data voltages of the same polarity during the two frame periods, a spatial frequency of the second liquid crystal cell increases. As a result, when an observer sees the liquid crystal display according to the embodiment, the observer scarcely feels the flicker. Because the observer simultaneously sees the first and second liquid crystal cells with his or her eyes sensitive to changes, the observer perceives a spatial frequency of the second liquid crystal cell as a spatial frequency of the first liquid crystal cell.

Figure 13:
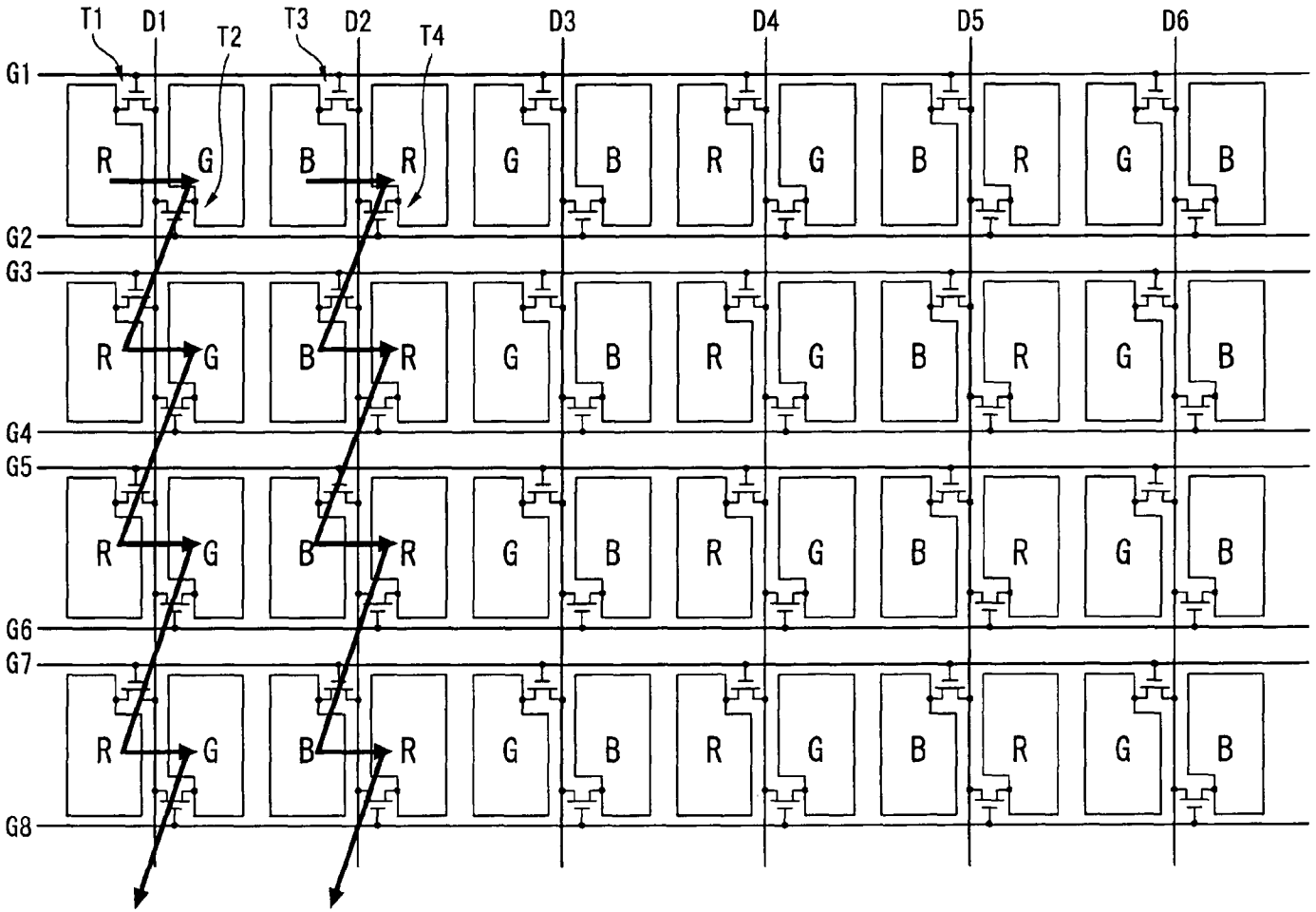
FIGS. 13 and 14 illustrate various examples of a double rate driving (DRD) panel applicable town embodiment.

The DRD panel may be configured so that all of the liquid crystal cells are charged to the data voltage in a Z-shaped charging order as shown in FIG. 13. Further, the DRD panel may be configured so that the liquid crystal cells are charged to the data voltage in a charging order shown in FIG. 14.

In the DRD panel shown in FIG. 13, each of first TFTs T1 supplies the data voltage from odd-numbered data lines D1, D3, . . . , Dm/2−1 to a pixel electrode 1 of each of first liquid crystal cells positioned on the left side of each of the odd-numbered data lines D1, D3, . . . , Dm/2−1 in response to a first gate pulse from odd-numbered gate lines G1, G3, . . . , G2*n*−1. For the above operation, in each of the first TFTs T1, a gate electrode is connected to the odd-numbered gate lines G1, G3, . . . , G2*n*−1, a drain electrode is connected to the odd-numbered data lines D1, D3, . . . , Dm/2−1, and a source electrode is connected to the pixel electrode 1 of each first liquid crystal cell. Each of second TFTs T2 supplies the data voltage from the odd-numbered data lines D1, D3, . . . , Dm/2−1 to a pixel electrode 1 of each of second liquid crystal cells positioned on the right side of each of the odd-numbered data lines D1, D3, . . . , Dm/2−1 in response to a second gate pulse from even-numbered gate lines G2, G4, G2*n*. For the above operation, in each of the second TFTs T2, a gate electrode is connected to the even-numbered gate lines G2, G4, . . . , G2*n*, a drain electrode is connected to the odd-numbered data lines D1, D3, . . . , Dm/2−1, and a source electrode is connected to the pixel electrode 1 of each second liquid crystal cell. Each of third TFTs T3 supplies the data voltage from even-numbered data lines D2, D4, . . . , Dm/2 to a pixel electrode 1 of each of third liquid crystal cells positioned on the left side of each of the even-numbered data lines D2, D4, . . . , Dm/2 in response to the first gate pulse from the odd-numbered gate lines G1, G3, . . . , G2*n*−1. For the above operation, in each of the third TFTs T3, a gate electrode is connected to the odd-numbered gate lines G1, G3, . . . , G2*n*−1, a drain electrode is connected to the even-numbered data lines D2, D4, . . . , Dm/2, and a source electrode is connected to the pixel electrode 1 of each third liquid crystal cell. Each of fourth TFTs T4 supplies the data voltage from the even-numbered data lines D2, D4, . . . , Dm/2 to a pixel electrode 1 of each of fourth liquid crystal cells positioned on the right side of each of the even-numbered data lines D2, D4, . . . , Dm/2 in response to the second gate pulse from the even-numbered gate lines G2, G4, G2*n*. For the above operation, in each of the fourth TFTs T4, a gate electrode is connected to the even-numbered gate lines G2, G4, G2*n*, a drain electrode is connected to the even-numbered data lines D2, D4, . . . , Dm/2, and a source electrode is connected to the pixel electrode 1 of each fourth liquid crystal cell.

Figure 14:
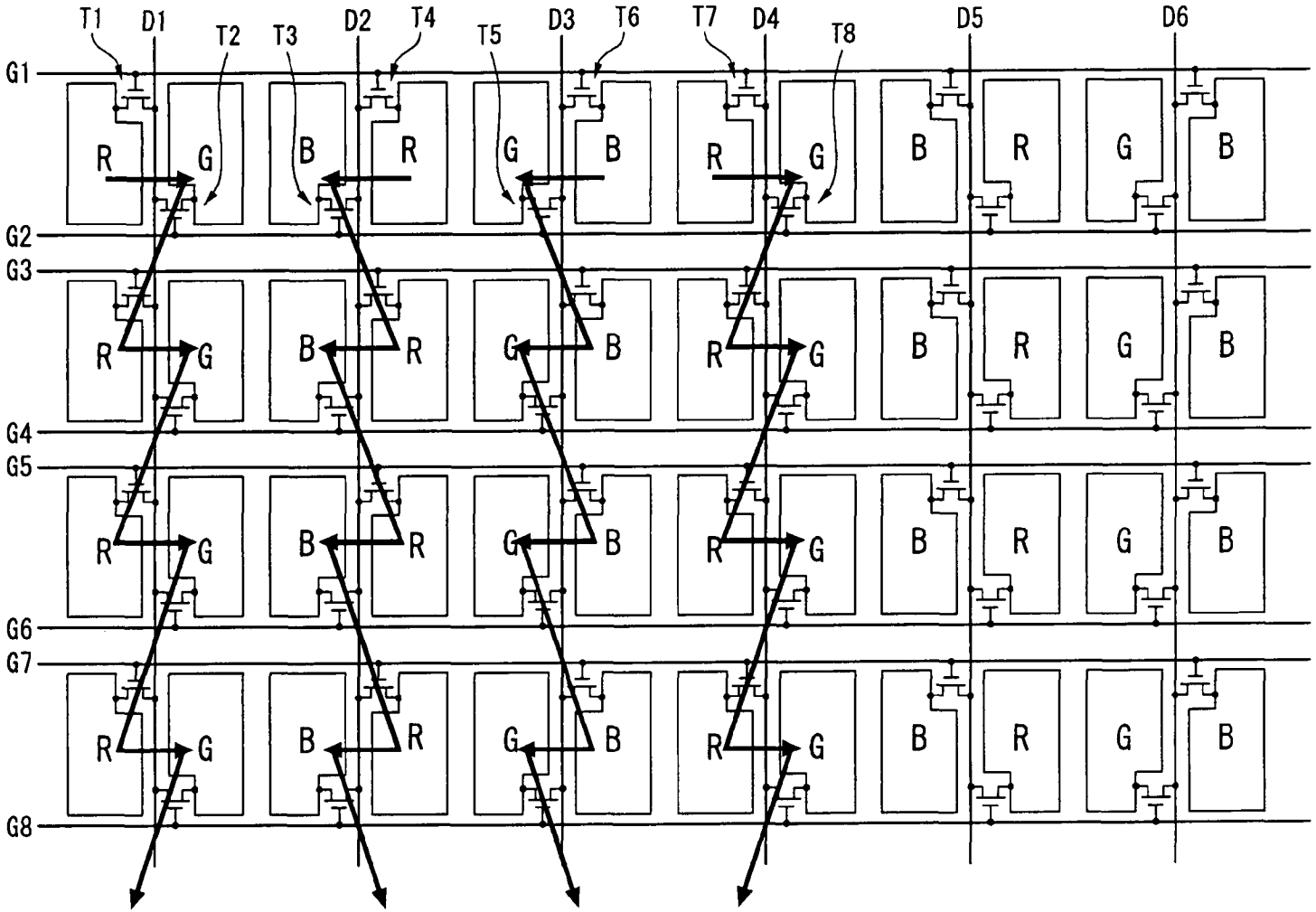

In the DRD panel shown in FIG. 14, each of first TFTs T1 supplies the data voltage from (4i+1)-th data lines D1, D5, . . . , Dm/2−3 to a pixel electrode 1 of each of first liquid crystal cells positioned on the left side of each of the (4i+1)-th data lines D1, D5, . . . , Dm/2−3 in response to a first gate pulse from odd-numbered gate lines G1, G3, . . . , G2*n*−1. For the above operation, in each of the first TFTs T1, a gate electrode is connected to the odd-numbered gate lines G1, G3, . . . , G2*n*−1, a drain electrode is connected to the (4i+1)-th data lines D1, D5, . . . , Dm/2−3, and a source electrode is connected to the pixel electrode 1 of each first liquid crystal cell. Each of second TFTs T2 supplies the data voltage from the (4i+1)-th data lines D1, D5, . . . , Dm/2−3 to a pixel electrode 1 of each of second liquid crystal cells positioned on the right side of each of the (4i+1)-th data lines D1, D5, . . . , Dm/2−3 in response to a second gate pulse from even-numbered gate lines G2, G4, G2*n*. For the above operation, in each of the second TFTs T2, a gate electrode is connected to the even-numbered gate lines G2, G4, G2*n*, a drain electrode is connected to the (4i+1)-th data lines D1, D5, . . . , Dm/2−3, and a source electrode is connected to the pixel electrode 1 of each second liquid crystal cell. Each of third TFTs T3 supplies the data voltage from (4i+2)-th data lines D2, D6, . . . , Dm/2−2 to a pixel electrode 1 of each of third liquid crystal cells positioned on the left side of each of the (4i+2)-th data lines D2, D6, . . . , Dm/2−2 in response to the second gate pulse from the even-numbered gate lines G2, G4, G2*n*. For the above operation, in each of the third TFTs T3, a gate electrode is connected to the even-numbered gate lines G2, G4, G2*n*, a drain electrode is connected to the (4i+2)-th data lines D2, D6, . . . , Dm/2−2, and a source electrode is connected to the pixel electrode 1 of each third liquid crystal cell. Each of fourth TFTs T4 supplies the data voltage from the (4i+2)-th data lines D2, D6, . . . , Dm/2−2 to a pixel electrode 1 of each of fourth liquid crystal cells positioned on the right side of each of the (4i+2)-th data lines D2, D6, . . . , Dm/2−2 in response to the first gate pulse from the odd-numbered gate lines G1, G3, . . . , G2*n*−1. For the above operation, in each of the fourth TFTs T4, a gate electrode is connected to the odd-numbered gate lines G1, G3, . . . , G2*n*−1, a drain electrode is connected to the (4i+2)-th data lines D2, D6, . . . , Dm/2−2, and a source electrode is connected to the pixel electrode 1 of each fourth liquid crystal cell. Each of fifth TFTs T5 supplies the data voltage from (4i+3)-th data lines D3, D7, . . . , Dm/2−1 to a pixel electrode 1 of each of fifth liquid crystal cells positioned on the left side of each of the (4i+3)-th data lines D3, D7, . . . , Dm/2−1 in response to the second gate pulse from the even-numbered gate lines G2, G4, G2*n*. For the above operation, in each of the fifth TFTs T5, a gate electrode is connected to the even-numbered gate lines G2, G4, G2*n*, a drain electrode is connected to the (4i+3)-th data lines D3, D7, . . . , Dm/2−1, and a source electrode is connected to the pixel electrode 1 of each fifth liquid crystal cell. Each of sixth TFTs T6 supplies the data voltage from the (4i+3)-th data lines D3, D7, . . . , Dm/2−1 to a pixel electrode 1 of each of sixth liquid crystal cells positioned on the right side of each of the (4i+3)-th data lines D3, D7, . . . , Dm/2−1 in response to the first gate pulse from the odd-numbered gate lines G1, G3, . . . , G2*n*−1. For the above operation, in each of the sixth TFTs T6, a gate electrode is connected to the odd-numbered gate lines G1, G3, . . . , G2*n*−1, a drain electrode is connected to the (4i+3)-th data lines D3, D7, . . . , Dm/2−1, and a source electrode is connected to the pixel electrode 1 of each sixth liquid crystal cell. Each of seventh TFTs T7 supplies the data voltage from (4i+4)-th data lines D4, D8, . . . , Dm/2 to a pixel electrode 1 of each of seventh liquid crystal cells positioned on the left side of each of the (4i+4)-th data lines D4, D8, . . . , Dm/2 in response to the first gate pulse from the odd-numbered gate lines G1, G3, . . . , G2*n*−1. For the above operation, in each of the seventh TFTs T7, a gate electrode is connected to the odd-numbered gate lines G1, G3, . . . , G2*n*−1, a drain electrode is connected to the (4i+4)-th data lines D4, D8, . . . , Dm/2, and a source electrode is connected to the pixel electrode 1 of each seventh liquid crystal cell. Each of eighth TFTs T8 supplies the data voltage from the (4i+4)-th data lines D4, D8, . . . , Dm/2 to a pixel electrode 1 of each of eighth liquid crystal cells positioned on the right side of each of the (4i+4)-th data lines D4, D8, . . . , Dm/2 in response to the second gate pulse from the even-numbered gate lines G2, G4, G2*n*. For the above operation, in each of the eighth TFTs T8, a gate electrode is connected to the even-numbered gate lines G2, G4, G2*n*, a drain electrode is connected to the (4i+4)-th data lines D4, D8, . . . , Dm/2, and a source electrode is connected to the pixel electrode 1 of each eighth liquid crystal cell.

In the DRD panel shown in FIGS. 13 and 14, the polarity of the data voltage supplied to the liquid crystal cells may be controlled in response to the first to fourth polarity control signals POL1 to POL4 or the reference polarity control signal POL shown in FIG. 7. In FIGS. 13 and 14, the arrow indicated by the bold solid line indicates the charging order of the data voltage.

The inventors confirmed through an experiment that when the data voltage whose the polarity is controlled using the polarity control signals shown in FIG. 7 is supplied to a DRD panel, for example, the DRD panel shown in FIGS. 13 and 14, the DC image sticking is reduced. However, the inventors observed 30 Hz-flicker, line flicker, column flicker, and color distortion of red in the DRD panel. The DRD panel may include one of the pixel arrays shown in FIGS. 2, 13, and 14. However, it is preferable that the pixel array shown in FIG. 2 is applied to the DRD panel because the pixel array shown in FIG. 2 is most advantageous in the improvement of the image quality when the polarity of the data voltage is controlled using the polarity control signals shown in FIG. 7 so as to reduce the DC image sticking.

As described above, in the liquid crystal display according to the embodiment, the cost of circuits constituting the liquid crystal display can be reduced by reducing the number of data lines and the number of output channels of the data drive circuit to ½ using the DRD panel. Further, the display quality of the DRD panel can be improved by reducing the DC image sticking, the flicker, the color distortion using the polarity control signals each having a different phase.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a liquid crystal display panel including a liquid crystal layer between an upper substrate and a lower substrate of the liquid crystal display panel, m×n liquid crystal cells arranged in a matrix format according to a crossing structure of m/2 data lines and 2n gate lines, and thin film transistors (TFTs) respectively connected to the m×n liquid crystal cells, where m and n are a positive integer;

a data drive circuit supplying a data voltage to the data lines in response to a polarity control signal;

a gate drive circuit sequentially supplying a gate pulse to the gate lines; and a POL logic circuit controlling the polarity control signal so that a phase of the polarity control signal varies every frame period, wherein the POL logic circuit sequentially outputs first to fourth polarity control signals to generate the polarity control signal, wherein the POL logic circuit sequentially performs an operation of generating the first polarity control signal during (4i+1)-th frame periods, an operation of generating the second polarity control signal, whose a phase is different from a phase of the first polarity control signal, during (4i+2)-th frame periods, an operation of generating the third polarity control signal, whose a phase is opposite to the phase of the first polarity control signal, during (4i+3)-th frame periods, and an operation of generating the fourth polarity control signal, whose a phase is opposite to the phase of the second polarity control signal, during (4i+4)-th frame periods, where i is a positive integer including zero.

2. The liquid crystal display of claim 1, wherein the liquid crystal cells include a first liquid crystal cell positioned on the left side of an odd-numbered data line, a second liquid crystal cell positioned on the right side of the odd-numbered data line, a third liquid crystal cell positioned on the left side of an even-numbered data line, and a fourth liquid crystal cell positioned on the right side of the even-numbered data line.

3. The liquid crystal display of claim 2, wherein the TFTs include:

a first TFT that supplies the data voltage from the odd-numbered data line to a pixel electrode of the first liquid crystal cell in response to a first gate pulse supplied to an odd-numbered gate line;

a second TFT that supplies the data voltage from the odd-numbered data line to a pixel electrode of the second liquid crystal cell in response to a second gate pulse supplied to an even-numbered gate line;

a third TFT that supplies the data voltage from the even-numbered data line to a pixel electrode of the third liquid crystal cell in response to the second gate pulse; and a fourth TFT that supplies the data voltage from the even-numbered data line to a pixel electrode of the fourth liquid crystal cell in response to the first gate pulse.

4. The liquid crystal display of claim 1, wherein the first polarity control signal has a high logic level of ½ horizontal period, a low logic level of ½ horizontal period, a high logic level of ½ horizontal period, a low logic level of 1 horizontal period, a high logic level of ½ horizontal period, a low logic level of ½ horizontal period, and a high logic level of ½ horizontal period in the order named, wherein the second polarity control signal has a high logic level of ½ horizontal period, a low logic level of 1 horizontal period, a high logic level of ½ horizontal period, a low logic level of ½ horizontal period, a high logic level of 1 horizontal period, and a low logic level of ½ horizontal period in the order named.

* * * * *